US012680228B2

(12) United States Patent
Araujo et al.

(10) Patent No.: US 12,680,228 B2
(45) Date of Patent: Jul. 14, 2026

(54) SYSTEM AND METHOD FOR THE REMOVAL OF NON-PROCESS ELEMENTS FROM ELECTROSTATIC PRECIPITATOR ASHES IN A KRAFT PULP PROCESS

(71) Applicant: L'Air Liquide, Societe Anonyme pour l'Etude et l'Exploitation des Procedes Georges Claude, Paris (FR)

(72) Inventors: Oliveira Araujo, Miraflores (PT); Philippe Campo, Bagneux (FR); Bruno Alban, Bagneux (FR); Bruno Veiga, Arruda (PT)

(73) Assignee: L'Air Liquide, Société Anonyme pour l'Etude et l'Exploitation des Procédés Georges Claude, Paris (FR)

( * ) Notice: Subject to any disclaimer, the term of this patent is extended or adjusted under 35 U.S.C. 154(b) by 106 days.

(21) Appl. No.: 18/597,770

(22) Filed: Mar. 6, 2024

(65) Prior Publication Data

US 2024/0301624 A1 Sep. 12, 2024

(30) Foreign Application Priority Data

Mar. 6, 2023 (EP) ..... 23160201

(51) Int. Cl.
*D21C 11/06* (2006.01)
*D21H 11/04* (2006.01)

(52) U.S. Cl.
CPC ..... *D21C 11/066* (2013.01); *D21C 11/063* (2013.01); *D21H 11/04* (2013.01)

(58) Field of Classification Search
CPC ..... D21C 11/066
See application file for complete search history.

(56) References Cited

U.S. PATENT DOCUMENTS

| | | | | |
|---|---|---|---|---|
| 3,183,145 | A * | 5/1965 | Collins, Jr. | D21C 11/06 159/DIG. 18 |
| 3,833,462 | A | 9/1974 | Moy et al. | |
| 4,007,082 | A | 2/1977 | Fuller | |
| 2011/0067829 | A1 | 3/2011 | Foan et al. | |

FOREIGN PATENT DOCUMENTS

| | | | |
|---|---|---|---|
| EP | 1 935 477 | 6/2008 | |
| EP | 2427598 B1 * | 1/2016 | D21C 11/06 |
| EP | 3 228 743 | 10/2017 | |
| WO | WO 96/12847 | 5/1996 | |
| WO | WO 2011/002354 | 1/2011 | |
| WO | WO 2016/099392 | 6/2016 | |
| WO | WO 2017/175044 | 10/2017 | |

OTHER PUBLICATIONS

EP Search Report and Written Opinion for EP 23 16 0201, mailed Aug. 18, 2023.

* cited by examiner

*Primary Examiner* — Anthony Calandra
(74) *Attorney, Agent, or Firm* — Yan Jiang

(57) ABSTRACT

The present application relates to a system and a method for the removal of non-process elements, such as $K^+$ or $Cl^-$, from electrostatic precipitator ashes in a kraft pulp process comprising the addition of a strong acid containing sulfur and $CO_2$ in separate steps in the ash treatment step.

9 Claims, 1 Drawing Sheet

SYSTEM AND METHOD FOR THE REMOVAL OF NON-PROCESS ELEMENTS FROM ELECTROSTATIC PRECIPITATOR ASHES IN A KRAFT PULP PROCESS

CROSS-REFERENCE TO RELATED APPLICATIONS

This application claims the benefit of priority under 35 U.S.C. § 119 (a) and (b) to EP patent application No. EP 23160201.2, filed Mar. 6, 2023, the entire contents of which are incorporated herein by reference.

FIELD OF THE INVENTION

This application relates to a system and a method for the removal of non-process elements, such as $K^+$ or $Cl^-$, from electrostatic precipitator ashes in a kraft pulp process comprising the addition of a strong acid containing sulfur and $CO_2$ in separate steps.

BACKGROUND

In a kraft pulp process, wood is transformed into pulp comprising pure cellulose fibers. Wood chips are first treated with a mixture of sodium hydroxide and sodium sulfide. The wood chips are then cooked in pressurized vessels, in which some operate in a batch, and some can operate continuously. The resulting pulp, which makes about 50% by weight of the dry wood chips, is collected and washed. The pulp is known as brown stock because of its color, while the combined resulting liquids are known as black liquor and contain lignin fragments, carbohydrates from the breakdown of hemicellulose, sodium carbonate, sodium sulfate and other inorganic salts. One of the main chemical reactions that underpin the kraft process is the scission of ether bonds by the nucleophilic sulfide ($S_2^-$) or bisulfide ($HS^-$) ions.

Weak black liquor is evaporated and burned in a recovery boiler to recover the inorganic chemicals to be reused in the pulping process. Part of the combustion products are emitted as a stream called fly ash that needs to be separated from the gas stream for environmental reasons related to ash discharge to air and for economic reasons since this stream contains chemicals such as $Na_2SO_4$ and $Na_2CO_3$ which are useful process chemicals. The separation of the fly ash is performed in an electrostatic precipitator (ESP) that generates an ash that can be recirculated back to the black liquor before it is fed to the recovery boiler.

In the kraft pulping process, the ESP ash also contains $K^+$ and $Cl^-$, known as non-process elements, which are noxious to the kraft process itself. Potassium salts create deposits in the tubes of the recovery boiler and reduces the heat exchange capacity of the boiler tube banks, while chloride salts create corrosion problems in the boiler tubes.

Different "ash leaching", ion-exchange or crystallization methods are currently being applied as a kind of "kidneys" to remove non-process elements, such as $K^+$ or $Cl^-$, from the kraft pulping process of many pulp mills. Such methods frequently require the use of strong acids containing sulfur, in most cases, residual spent acid from the chlorine dioxide plant and/or sulfuric acid.

Ash treatment processes as a way to remove non-process elements generally have a preliminary step which involve the preparation of a solution of ash in water. The ash is transformed into a slurry or saturated ash solution by adding water or with filtrate from a previous selective removal of $K^+$ and $Cl^-$ from the recovery boiler ESP ashes, and then the slurry or saturated ash solution is further treated for $K^+$ and $Cl^-$ removal. The initial range of pH of the slurry or saturated ash solution is between 11 and 12. In most non-process elements removal methods this high pH must be reduced, carbonate must be converted into bicarbonate to improve $K^+$ and $Cl^-$ removal. pH should be between 8 and 10 for the content of carbonate ions to be sufficiently low. For this purpose, sulfuric acid and/or residual spent acid from the $ClO_2$ generation system used in pulp bleaching are used. However, sulfur contained in these acids is reduced in the recovery cycle and increase the sulfidity in this cycle, creating pulp quality problems and environmental problems to the pulp mill.

In order to control the input of sulfur in the kraft process, these acids can be partially or totally substituted by $CO_2$. When $CO_2$ is dissolved in the slurry of saturated ash solution it will partly convert itself as well as part of the carbonates in the slurry or saturated ash solution into bicarbonates, i.e., if the desired end pH is not less than 8.3.

In parallel, when a strong acid is added to the slurry or saturated ash solution, the carbonates and bicarbonates of the mixture will be destroyed, and $CO_2$ gas will be released. Therefore, it is possible that when $CO_2$ and strong acids are added to the $CO_2$ in the same volume of the tank with agitation containing the ash, $CO_2$ will react with the carbonates contained in the slurry or saturated ash solution and produce bicarbonates and then the acid being added will destroy the bicarbonates and carbonates, resulting in a $CO_2$ gas loss that will go out of the system through the chimney or vent of the tank. There is clearly a reduction in the efficiency of $CO_2$ utilization by this method, although this does not mean that the dissolution efficiency of $CO_2$ in the system, by using a static mixer or other device that is disclosed in EP3228743A1, is bad.

RELATED ART

Other previous, but technically different, technologies in this technical field include the alternative method for selective removal of $K^+$ and $Cl^-$ from recovery boiler electrostatic precipitator ashes disclosed in WO2017175044A1, a process for purifying electrostatic precipitator ash of chlorides and potassium by means of leaching, filtering and washing a filter cake disclosed in WO 1996012847 A, or the process of removing sodium chloride which has accumulated in the precipitator ash of the kraft pulping process chemical recovery systems without undue loss of sodium sulfate and other useful chemicals disclosed in U.S. Pat. No. 3,833,462 A. However, neither these technologies previously disclosed employ the system and method steps of the present invention.

SUMMARY OF THE INVENTION

The present application relates to a system for the removal of non-process elements from electrostatic precipitator ashes in a kraft pulp process with an ash treatment step comprising:

- a first tank (1) comprising agitation means (2), which is fluidly connected to a second tank (5) comprising agitation means (2'); the second tank (5) comprises a recirculation loop (6), wherein the recirculation loop (6) comprises pipes (6.1), at least one pump (6.2), a $CO_2$ injection line (6.3) and mixing means (6.4).

In one embodiment, the first tank (1) comprises a recirculation loop (11) that comprises pipes (11.1), at least one pump (11.2), a strong acid containing sulfur injection line (11.3) and mixing means (11.4).

In one embodiment the mixing means (6.4) and (11.4) are selected from a static mixer or a venturi mixer.

In one embodiment the first tank (1) comprises a vent to the atmosphere (10).

The present application also relates to a method for the removal of non-process elements from electrostatic precipitator ashes in a kraft pulp process with an ash treatment step, comprising the following steps:

- A first reaction step performed in a first tank (1) with agitation means (2) wherein a strong acid containing sulfur is added to a slurry or saturated ash solution (4) to lower its pH between 8 and 10;
- The slurry or saturated ash solution resulting from the previous step (4') is transferred to a second tank (5) with agitation means (2');
- A second reaction step performed in the second tank (5) with agitation means (2') wherein $CO_2$ is added to the slurry or saturated ash solution (4') via a recirculation loop (6).

In one embodiment the non-process elements are $K^+$ or $Cl^-$.

In one embodiment the first and second reaction steps are performed at a temperature between 50 and 98° C., a pressure between 50 and 150 KPa, and between 10 and 1000 minutes of residence time.

In one embodiment the slurry or saturated ash solution (4) is obtained by mixing dry ash (8) with water or black liquor condensate, or with filtrate coming from a previous selective removal of $K^+$ and Cl from recovery boiler electrofilter ashes and water (9).

In one embodiment between 1 to 2 kg of filtrate and water are added per kg of dry ash (8) to produce the slurry or saturated ash solution (4).

In one embodiment the strong acid containing sulfur is added in a concentration up to 500 kg of strong acid containing sulfur/ton of dry ash (8).

In one embodiment between 0.01 and 0.50 kg of $CO_2$ is added per kg of dry ash (8).

In one embodiment the $CO_2$ added has a purity degree between 99.00 and 100.0% or between 1.0 and 98.9%.

In one embodiment, $CO_2$ is added as a gas, liquid, or solid phase.

In one embodiment, the initial pH of the slurry or saturated ash solution is above 10 and the pH after applying the method is below 9.

The present application discloses a system and a method for the removal of non-process elements, such as $K^+$ or $Cl^-$, from electrostatic precipitator ashes in a kraft pulp process with an ash treatment step.

The system comprises two separate tanks with agitation, a first tank suitable for the addition of a strong acid containing sulfur, and a second tank comprising a circulating loop suitable for the addition of $CO_2$.

The method comprises the addition of a strong acid containing sulfur and $CO_2$ in separate steps during the ash treatment step. The method aims to control the sulfidity of the recovery cycle in the kraft pulping process while achieving an efficient removal of non-process elements.

The present system and method allow optimizing the kraft pulp process conditions for the use of a strong acid containing sulfur, for example sulfuric acid and/or residual spent acid, and $CO_2$.

In order to increase the $CO_2$ process utilization efficiency, it is considered that the efficiency of use of $CO_2$ in this method is not limited to the dissolution efficiency only using a static mixer or other convenient means, but also to the fact that a strong acid containing sulfur is used in the method, together with $CO_2$. The system and method proposed allows the best use of the binomium Acid/$CO_2$ and allows the reduction of the input of sulfur due to the use of a strong acid containing sulfur and so reduce the impact in sulfidity of the kraft process, as well as reducing losses of $CO_2$ due to inefficiency of adding acid and $CO_2$ in the same tank with agitation.

The pH of the alkaline solution, i.e., slurry or saturated ash solution, is reduced using a strong acid containing sulfur and $CO_2$. It was found that it is advisable to apply the strong acid first, to reduce pH and alkalinity of the slurry or saturated ash solution, by destroying carbonates and bicarbonates. Then $CO_2$, which produces no change in alkalinity, is added to the slurry or saturated ash solution which already has a lower alkalinity than the initial slurry or saturated ash solution, and therefore less $CO_2$ is used than if the strong acid and $CO_2$ were added at the same time or if $CO_2$ was added followed by the addition of a strong acid.

To achieve this, the system and method comprise the separation of the reaction phase with the strong acid containing sulfur from the reaction phase with $CO_2$. This can be done by adding the strong acid containing sulfur in a first separate tank with agitation means suitable to receive the slurry or ash solution from the electrostatic precipitator, and then transfer the mixture to a second tank with agitation means where the $CO_2$ is added through a recirculation loop comprising at least one pump and mixing means, such as a static mixer or other appropriate mixing means.

An additional strategy to further separate the method two phases, i.e. the reaction with strong acid containing sulfur and the reaction with $CO_2$ is:

- The strong acid containing sulfur can be added with a recirculation loop comprising a pump and mixing means installed in a first tank with agitation means, so that the slurry or saturated ash solution is passed through the mixing means to eliminate any short circuit in the addition of the strong acid and will cause the strong acid to only react in the first tank with agitation means;
- The $CO_2$ will then be added with a recirculation loop installed in the second tank with agitation.

With this strategy both reactants, the strong acid containing sulfur and $CO_2$, will be used in an optimum way and loss of $CO_2$ due to interference of both reactants will be negligible.

For the purposes of this patent application, a tank with agitation is considered any tank suitable to receive the slurry or saturated ash solution, in which the tank comprises any type of agitation means suitable to mix its contents.

For the purposes of this patent application, pure $CO_2$ is intended to be a $CO_2$ stream with a purity degree between 99.00 and 100.0%, and impure $CO_2$ is intended to be a $CO_2$ stream with a purity degree between 1.0 and 98.9%.

In the method of the present application, $CO_2$ is used either in pure or impure form for the removal of non-process elements. $CO_2$ is added as gas, liquid, or solid phase in order to react with the slurry or saturated ash solution.

BRIEF DESCRIPTION OF DRAWINGS

For easier understanding of this application, figures are attached in the annex that represent the preferred forms of implementation which nevertheless are not intended to be limiting of the invention, in which.

DETAILED DESCRIPTION OF THE INVENTION

Now, preferred embodiments of the present application will be described in detail with reference to the annexed drawings. However, they are not intended to limit the scope of this application.

The present application relates to a system and a method for the removal of non-process elements, such as $K^+$ or $Cl^-$, from electrostatic precipitator ashes in a kraft pulp process with an ash treatment step.

The present system and method are suitable for a kraft process system, which comprises an electrostatic precipitator, recovery boiler and at least one tank with agitation where dry ash is added to water (wherein water can be condensate from the evaporation of Black Liquor), or that comprises a filtrate obtained from a previous selective removal of $K^+$ and $Cl^-$ from recovery boiler electrofilter ashes, this being the first tank (1) of the presently disclosed system, in order to obtain a slurry or saturated ash solution to be further processed through the method of the present application.

Figure 1:
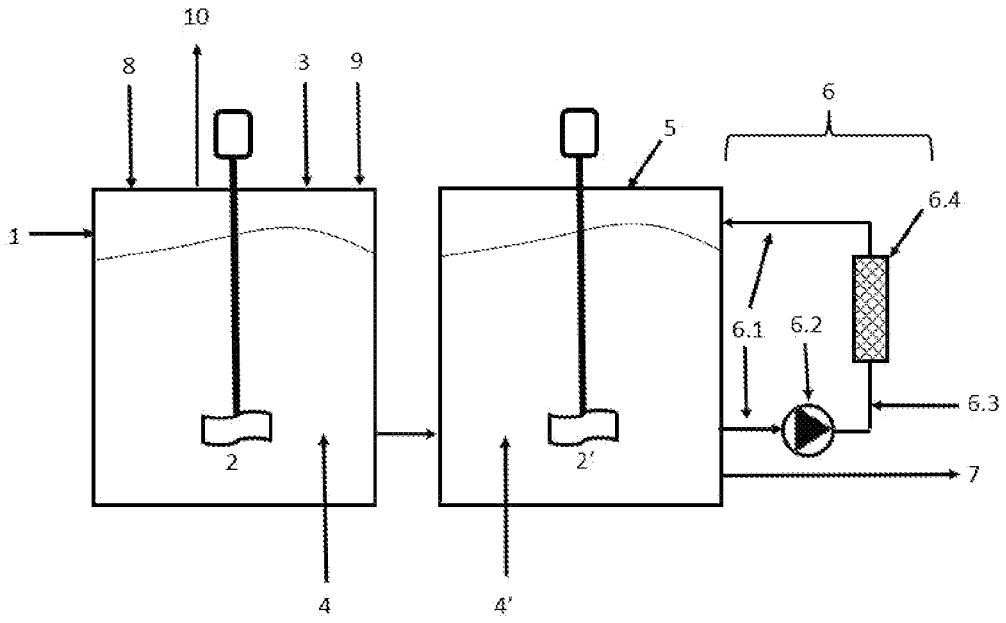
FIG. 1 shows a schematic representation of a first embodiment of the present invention.

FIG. 1 shows the system for the removal of non-process elements from electrostatic precipitator ashes in a kraft pulp process with an ash treatment step.

The system comprises a first tank (1) comprising agitation means (2), which is fluidly connected to a second tank (5) comprising agitation means (2'), and wherein the second tank (5) comprises a recirculation loop (6).

In one embodiment, the recirculation loop (6) comprises pipes (6.1), at least one pump (6.2), a $CO_2$ injection line (6.3) and mixing means (6.4).

The recirculation loop (6) has the purpose of adding and mixing $CO_2$ with the slurry or saturated ash solution (4') of the second tank (5).

The mixing means (6.4) are selected from, but not limited to, a static mixer, a venturi mixer, or any other mixing means suitable for the purpose.

Figure 2:
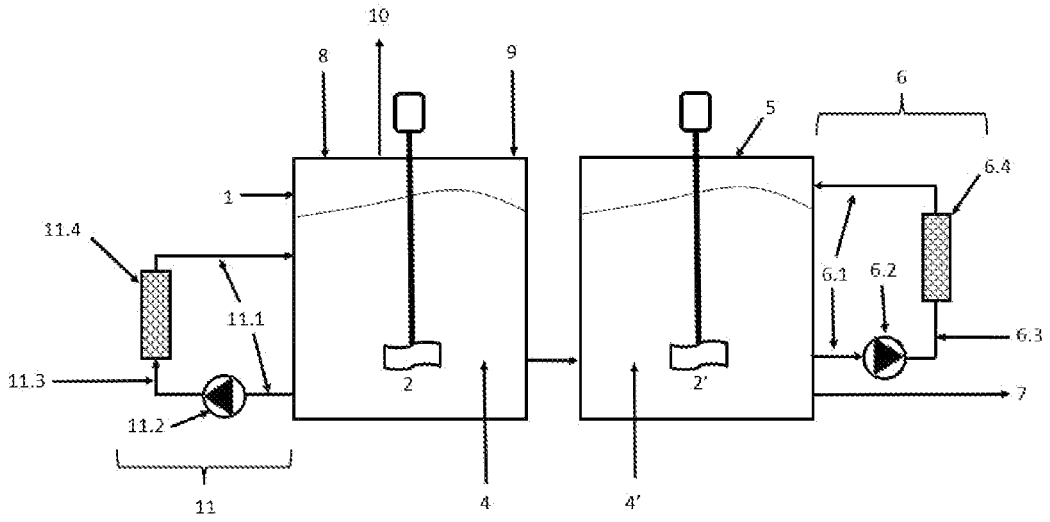
FIG. 2 shows a schematic representation of a second embodiment of the present invention.

In one embodiment, as shown in FIG. 2, the strong acid containing sulfur (3) is added directly to the first tank (1).

In one embodiment, as shown in FIG. 2, the first tank (1) comprises a recirculation loop (11) for the addition of the strong acid containing sulfur. The recirculation loop (11) comprising pipes (11.1), at least one pump (11.2), a strong acid containing sulfur injection line (11.3) and mixing means (11.4). The mixing means (11.4) are selected from, but not limited to, a static mixer, a venturi mixer, or any other mixing means suitable for the purpose. The strong acid containing sulfur added via a recirculation loop (11) allows the slurry or saturated ash solution to passed through the mixing means to eliminate any short circuit in the addition of the strong acid containing sulfur and will cause the strong acid containing sulfur to only react in the first tank (1) with agitation means (2).

In one embodiment, the first tank (1) comprises a vent to the atmosphere (10).

The method for the removal of non-process elements from electrostatic precipitator ashes in a kraft pulp process with an ash treatment step, comprises the following steps:

A first reaction step performed in a first tank (1) with agitation means (2) wherein a strong acid containing sulfur is added to a slurry or saturated ash solution (4) to lower its pH between 8 and 10;

The slurry or saturated ash solution resulting from the previous step (4') is transferred to a second tank (5) with agitation means (2');

A second reaction step performed in the second tank (5) with agitation means (2') wherein $CO_2$ is added to the slurry or saturated ash solution (4') via a recirculation loop (6).

The recirculation loop (6) circulates the slurry or saturated ash solution (4') from the second tank (2) to the mixing means (6.4) to mix $CO_2$ with the slurry or saturated ash solution (4') and circulate the resulting mixture back into the second tank (2).

In one embodiment, the strong acid containing sulfur is added to a slurry or saturated ash solution (4) via a recirculation loop (11). The recirculation loop (11) circulates the slurry or saturated ash solution (4) from the first tank (1) to the mixing means (11.4) to mix the strong acid containing sulfur with the slurry or saturated ash solution (4) and circulate the resulting mixture back into the first tank (1), as shown in FIG. 2.

In one embodiment, the first and second reaction steps are performed at a temperature between 50 and 98° C., a pressure between 50 and 150 KPa, and between 10 and 1000 minutes of residence time.

In one embodiment, the slurry or saturated ash solution (4) is obtained by mixing dry ash (8) with water or with filtrate coming from a previous selective removal of $K^+$ and Cl from recovery boiler electrofilter ashes and water (9), optionally this water is condensate from the black liquor evaporation plant.

In one embodiment, between 1 to 2 kg of filtrate and water are added per kg of dry ash in order to produce slurry or saturated ash solution (4).

In one embodiment, the strong acid containing sulfur is selected from, but not limited to, sulfuric acid and/or spent acid. In one embodiment, the spent acid is obtained from a chlorine dioxide plant. In one embodiment, the strong acid containing sulfur is added in a concentration up to 500 kg of strong acid containing sulfur/ton of dry ash.

In one embodiment, pure $CO_2$ is added in the method with a purity degree between 99.00 and 100.0%. In another embodiment, impure $CO_2$ is added in the method with a purity degree between 1.0 and 98.9%.

In one embodiment, $CO_2$ is added in the method as a gas, liquid, or solid phase. In one embodiment, between 0.01 and 0.50 kg of $CO_2$ is added per kg of dry ash.

In one embodiment, the initial (i.e., pre-method) pH of the slurry or saturated ash solution is above 10. In another embodiment, the pH of the slurry or saturated ash solution is below 9 after applying the method of the present application.

The presently disclosed method is preferably performed in the presently disclosed system.

Experimental Trials

In trials of the presently disclosed method, the initial situation of the pulp mill sulfidity was high and above the quality specifications for pulp production due to the sole use of strong acids, such as spent acid from $ClO_2$ installation and sulphuric acid.

After treatment with the presently disclosed method, the levels of sulfidity returned to normal values and the removal efficiencies of $K^+$ and $Cl^-$ were considered normal.

This description is of course not in any way restricted to the forms of implementation presented herein and any person with an average knowledge of the area can provide many possibilities for modification thereof without departing from the general idea as defined by the claims. The preferred forms of implementation described above can obviously be combined with each other. The following claims further define the preferred forms of implementation.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing i.e. anything else may be additionally included and remain within the scope of "comprising." "Comprising" is defined herein as necessarily encompassing the more limited transitional terms "consisting essentially of" and "consisting of"; "comprising" may therefore be replaced by "consisting essentially of" or "consisting of" and remain within the expressly defined scope of "comprising".

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range. Any and all ranges recited herein are inclusive of their endpoints (i.e., x=1 to 4 or x ranges from 1 to 4 includes x=1, x=4, and x=any number in between), irrespective of whether the term "inclusively" is used.

All references identified herein are each hereby incorporated by reference into this application in their entireties, as well as for the specific information for which each is cited.

What is claimed is:

1. A method for removal of non-process elements from electrostatic precipitator ashes in a kraft pulp process with an ash treatment step, the method comprising the following steps:

a) in a first tank (1) with agitation means (2), adding a strong acid containing sulfur to a slurry or saturated ash solution (4) to lower its pH between 8 and 10;

b) transferring the slurry or saturated ash solution resulting from the previous step (4') to a second tank (5) with second agitation means (2');

c) in the second tank (5) with the second agitation means (2'), adding $CO_2$ to the slurry or saturated ash solution (4') via a recirculation loop (6), wherein the $CO_2$ added has a purity degree between 99.00 and 100.0% or a purity degree between 1.0 and 98.9%.

2. The method of claim 1, wherein the non-process elements are $K^+$ or $Cl^-$.

3. The method of claim 1, wherein the a) and c) steps are performed at a temperature between 5° and 98° C., a pressure between 50 and 150 KPa, and between 10 and 1,000 minutes of residence time.

4. The method of claim 1, wherein the slurry or saturated ash solution (4) is obtained by mixing dry ash (8) with water or black liquor evaporation condensate, or with filtrate coming from a previous selective removal of $K^+$ and $Cl^-$ from recovery boiler electrostatic precipitator ashes and water (9).

5. The method of claim 4, wherein between 1 to 2 kg of filtrate and water are added per kg of dry ash (8) to produce the slurry or saturated ash solution (4).

6. The method of claim 4, wherein the strong acid containing sulfur is added in a concentration up to 500 kg of strong acid containing sulfur/ton of dry ash (8).

7. The method of claim 4, wherein between 0.01 and 0.50 kg of $CO_2$ is added per kg of dry ash (8).

8. The method of claim 1, wherein $CO_2$ is added as a gas, liquid, or solid phase.

9. The method of claim 1, wherein the initial pH of the slurry or saturated ash solution is above 10 and the pH after applying the method is between 8 and 9.

* * * * *